United States Patent [19]

Baynes

[11] 4,412,678

[45] Nov. 1, 1983

[54] SADDLE FOR BAR AND BAR-TYPE WEIGHT

[75] Inventor: William R. Baynes, DuQuoin, Ill.

[73] Assignee: Turco Manufacturing Co., DuQuoin, Ill.

[21] Appl. No.: 341,323

[22] Filed: Jan. 22, 1982

Related U.S. Application Data

[63] Continuation of Ser. No. 49,234, Jun. 18, 1979, abandoned.

[51] Int. Cl.[3] ..... A63B 21/00

[52] U.S. Cl. ..... 272/123; 248/219.4

[58] Field of Search ..... 272/123, 122, 93, 134, 272/117; 248/219.2, 219.4

[56] References Cited

U.S. PATENT DOCUMENTS 3,469,520 9/1969 Foy et al. ..... 248/219.2 X 4,306,715 12/1981 Sutherland ..... 272/117

FOREIGN PATENT DOCUMENTS 2037594 of 1980 Canada ..... 272/123

*Primary Examiner*—Richard J. Apley

*Assistant Examiner*—William R. Browne

*Attorney, Agent, or Firm*—Rogers, Eilers & Howell

[57] ABSTRACT

A saddle for the bar of a bar-type weight has a bar-receiving portion, arms that incline upwardly and away from that portion, and a socket-forming portion which defines a socket that extends downwardly relative to those arms to telescope downwardly over the upper end of a rod-like support; and that saddle is unitary in nature and is wholly devoid of joints between any of the bar-receiving portion, the arms and the socket-forming portion. The bar-receiving portion has a part thereof which is located above the level of one edge thereof so a gap will always exist between that edge and the bar of the bar-type weight. The upper ends of the arms have horizontally-directed outwardly-extending lips that increase the effective area of the saddle which can be engaged by the bar of a bar-type weight without directing that bar away from that saddle.

4 Claims, 7 Drawing Figures

SADDLE FOR BAR AND BAR-TYPE WEIGHT

This application is a continuation of application Ser. No. 049,234 filed June 18, 1979, abandoned.

BACKGROUND OF THE INVENTION

Benches, which are used by weight lifters, customarily have saddles in which the bars of bar-type weights can be supported before and after the weight lifters exert the forces needed to lift those weights. Those saddles customarily are lengths of metal bars of rectangular cross section which have the ends thereof bent upwardly to define bar-receiving spaces and which have the lower surfaces thereof welded to the upper ends of vertically-directed rod-like supports. The strength characteristics of such a saddle can be calculated precisely and the strength characteristics of such a vertically-directed rod-like support also can be calculated precisely, but the strength characteristics of the weld between that saddle and that vertically-directed support cannot be calculated precisely; because weld strength characteristics will vary with the skill of, and the care used by, the welder. Further, if all of the acid-type flux used in making the weld is not removed, and if all of the electrolyte used in electroplating that saddle, weld and support is not removed, an initially sound weld could become unsound.

SUMMARY OF THE INVENTION

The present invention provides a saddle for the bar of a bar-type weight which has a constant and predetermined ability to withstand static and dynamic forces that are applied to it by the bar of such a bar-type weight. That saddle has a bar-receiving portion, arms that incline upwardly and away from that portion, and a socket-forming portion which defines a socket that extends downwardly relative to those arms to telescope downwardly over the upper end of a rod-like support; and that saddle is unitary in nature and is wholly devoid of joints between any of the bar-receiving portion, the arms and the socket-forming portion. As a result, that saddle does not require, and does not have, a weld between any of the bar-receiving portion, the arms, and the socket-forming portion; and hence has a constant and predetermined ability to withstand static and dynamic forces that are applied to it by the bar of such a bar-type weight. It is, therefore, an object of the present invention to provide a saddle for the bar of a bar-type weight which has a bar-receiving portion, arms that incline upwardly and away from that portion, and a socket-forming portion which defines a socket, and which is unitary in nature and is wholly devoid of joints between any of the bar-receiving portion, the arms, and the socket-forming portion.

The bar-receiving portion of the saddle provided by the present invention has a part thereof which is located above the level of one edge thereof so a gap will always exist between that edge and the bar of the bar-type weight. Such a gap will protect the weight-lifter's fingers against injury, even if a part of one of those fingers accidentally extends over the one edge of the saddle. It is, therefore, an object of the present invention to provide a bar-receiving portion, of a saddle for a bar-type weight, that has a part thereof which is located above the level of one edge thereof so a gap will always exist between that edge and the bar of the bar-type weight.

The upper ends of the arms of the saddle provided by the present invention have horizontally-directed outwardly-extending lips. If the bar of a bar-type weight is lowered down onto either of those lips, it will be supported by those lips without being given a horizontally-directed component of force. As a result those lips increase the effective area of the saddle which can be engaged by the bar of a bar-type weight without directing that bar away from that saddle. It is, therefore, an object of the present invention to provide horizontally-directed outwardly-extending lips at the upper ends of the arms of a saddle for the bar of a bar-type weight.

The arms of the saddle provided by the present invention merge into the bar-supporting portion of that saddle at points which are immediately adjacent the socket of that saddle. As a result, no points of engagement between that bar-supporting portion and the bar of a bar-type support can be displaced an appreciable distance outwardly beyond that socket. It is, therefore, an object of the present invention to provide a saddle wherein no points of engagement between the bar-supporting portion of that saddle and the bar of a bar-type weight can be displaced an appreciable distance outwardly beyond the socket of that saddle.

DETAILED DESCRIPTION OF PREFERRED EMBODIMENTS

Figures 1, 2, 3, 4, 5, 6, 7:
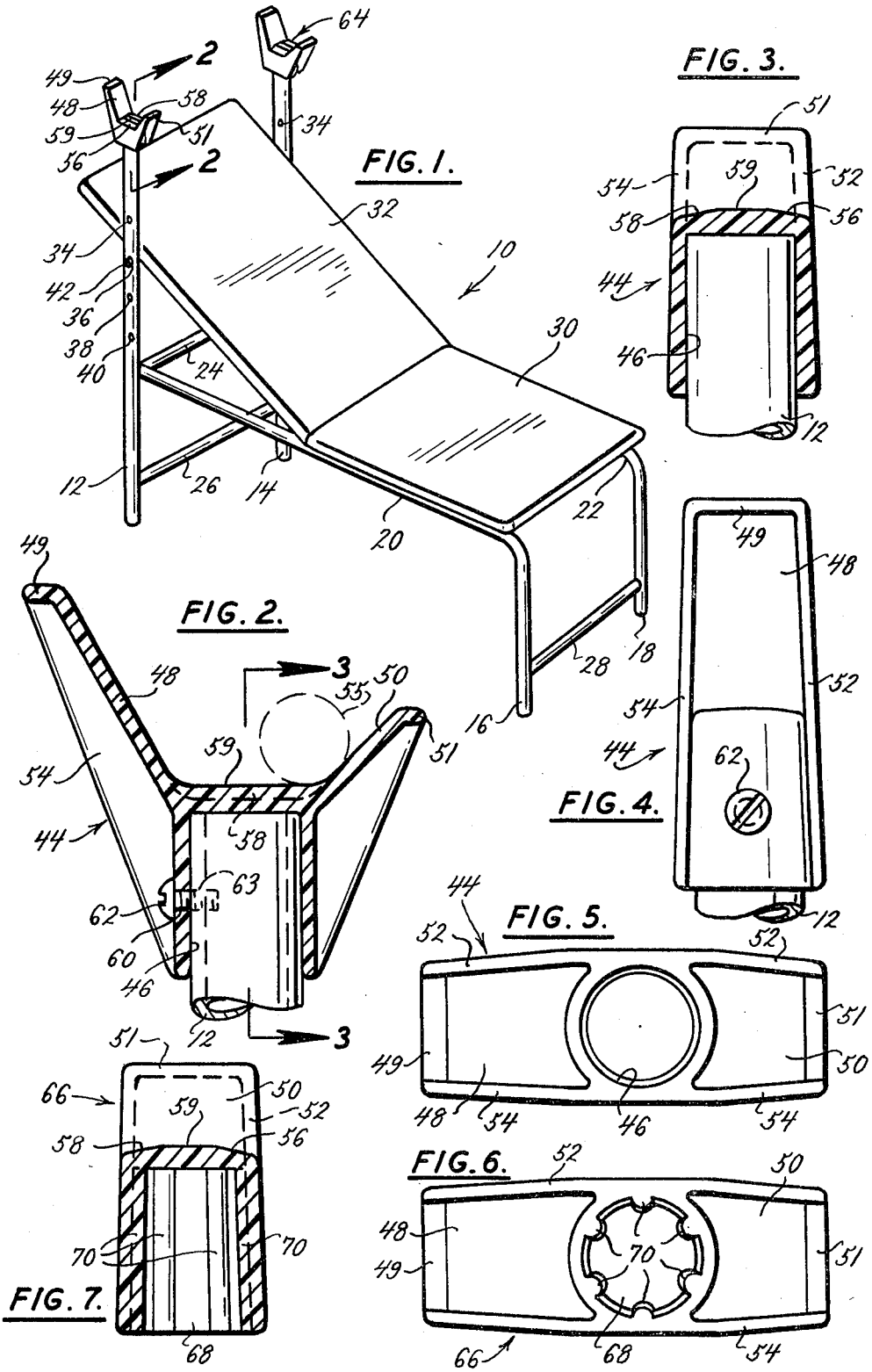
FIG. 1 is a perspective view of a weight-lifting bench which utilizes saddles, for the bar of a bar-type weight, that are made in accordance with the principles and teachings of the present invention.
FIG. 2 is a sectional view, on a larger scale, which is taken along the plane indicated by the line 2—2 in FIG. 1.
FIG. 3 is a sectional view, on the scale of FIG. 2, which is taken along the plane indicated by the line 3—3 in FIG. 2.
FIG. 4 is an elevational view, on the scale of FIG. 2, of the rear end of the saddle of FIG. 2.
FIG. 5 is a bottom view, on the scale of FIG. 2, of the saddle of FIG. 2.
FIG. 6 is a bottom view, on the scale of FIG. 2, of an alternate form of saddle, for the bar of a bar-type weight.
FIG. 7 is a vertical section through the center line of the saddle of FIG. 6.

Referring particularly to FIGS. 1–5, the numeral 10 generally denotes the frame of a weight bench of standard and usual design. That frame has legs 12, 14, 16 and 18, longerons 20 and 22, and cross braces 24, 26 and 28. Those legs, longerons and cross braces are made from metal tubing. The leg 16 and the longeron 20 are formed from a length of metal tubing by a bending operation; and, similarly, the leg 18 and the longeron 22 are formed from another length of metal tubing by a bending operation. The rear ends of the longerons 20 and 22 are suitably secured to the legs 12 and 14 by bolt and nut combinations, not shown. The cross braces 24 and 26 are secured to the legs 12 and 14 by nut and bolt combinations, not shown; and the cross brace 28 is secured to the legs 16 and 18 by bolt and nut combinations, not shown. Pairs of openings 34, 36, 38 and 40 are formed in the upper portions of the legs 12 and 14; and the openings of each pair of openings are at the same level and are aligned with each other. Those pairs of openings selectively receive a rod 42. A padded bench portion 30 is secured to the longerons 20 and 22; and a padded inclined board 32 has its lower end supported by those longerons, and has its upper end resting upon the rod 42.

The frame 10, the padded bench 30, the padded inclined board 32, and the rod 42 are not, per se, parts of the present invention. Instead, they are merely parts of a standard and usual weight lifter's bench, and they could be made in various sizes and configurations. For example, the legs 12 and 14 could be made to have an outer diameter of one and one-quarter inches, could be made to have an outer diameter of one inch, or could be made to have outer diameters of any appropriate dimension.

The numeral 44 generally denotes a saddle, for the bar of a bar-type weight, which is made in accordance with the principles and teachings of the present invention. That saddle has a cylindrical socket 46 at the bottom thereof which telescopes downwardly over the upper end of the leg 12. The upper end of that socket has a diameter which is just ten-thousandths of an inch larger than the outer diameter of that leg; and that socket has only one-half of a degree of draft. As a result, the inner surface of that socket intimately engages the upper end of the leg 12; and the consequent intimate engagement between that inner surface and that upper end will distribute any forces, due to turning couples, along the length of that inner surface. In this way, the present invention avoids the undesired concentration of forces that inevitably occurs when forces, due to turning couples, are applied to a saddle which has been welded to a support. Also, that intimate engagement between that inner surface and that upper end will prevent any tilting of the saddle 44 relative to the leg 12.

The socket 46 has a length or depth which is greater than the diameter of that socket. In one preferred embodiment of the present invention, the length or depth of that socket is one and twenty-seven thirty-seconds of an inch, whereas the diameter of the upper end of that socket is one and twenty-six hundredths of an inch. The wall of that socket has a minimum thickness of one hundred and twenty-five thousandths of an inch.

The numeral 48 denotes an arm which inclines upwardly and rearwardly from a bar-receiving portion 59; and that arm and the axis of the socket 46 coact to subtend an angle of about thirty degrees. The upper end of that arm has an outwardly-projecting lip 49 which is horizontally directed. The numeral 50 denotes an arm that extends upwardly and forwardly relative from bar-receiving portion 59; and that arm coacts with the axis of socket 46 to subtend an angle of about forty-five degrees. The upper end of arm 50 has an outwardly-projecting lip 51 which is horizontally-directed. Because the lips 49 and 51 are horizontally-directed, they will not respond to any lowering of the bar, of a bar-type weight, onto them to apply outwardly-directed forces to that bar. As a result, those lips increase the effective bar-receiving area of the saddle 44 without tending to direct the bar, of a bar-type weight, outwardly and away from that saddle.

A gusset-like reinforcing portion 52 is a tangentially-directed part of the portion of saddle 44 in which the socket 46 is located; and that reinforcing portion extends to, and defines, one side of each of the arms 48 and 50. A rounded edge, having a radius of at least one-sixteenth of an inch, is provided where the reinforcing portion 52 defines those sides of those arms. A similar gusset-like reinforcing portion 54 is a tangentially-directed part of the portion of saddle 44 in which the socket 46 is located; and that reinforcing portion extends to, and defines, the opposite side of each of the arms 48 and 50. A rounded edge, having a radius of at least one-sixteenth of an inch, is provided where the reinforcing portion 54 defines those opposite sides of those arms. Those reinforcing portions reinforce and strengthen both of the arms 48 and 50, both of the lips 49 and 51, and the socket-forming portion of saddle 44. In addition, those reinforcing portions would guide any bar, of a bar-type weight, which was being moved upwardly along a path in register with either of the lips 49 and 51, away from and past the outer end of that lip. As a result, the timing and flow of the upward movement of that bar could not be interrupted by that lip.

The bar-receiving portion 59 is shown as being planar and as being horizontally-directed. As a result, that portion will provide surface-to-surface engagement with any bar, of a bar-type weight, that is rested upon the saddle 44. That bar-receiving portion coacts with the arms 48 and 50 to define a bar-receiving area which generally has the form of a truncated V. In the said one preferred embodiment, the horizontal distance between the change of curvature between lip 49 and arm 48 is spaced about two and three thirty-seconds of an inch from the geometric axis of socket 46; and the horizontal distance between the change of curvature between lip 51 and arm 50 is about one and twenty-three thirty-seconds of an inch from that geometric axis. However, because the lips 49 and 51 are horizontally-directed, and because they project outwardly beyond the upper ends of the inclined inner faces of the arms 48 and 50, respectively, the shortest horizontal bar-intercepting projection of saddle 44 is four and nine-sixteenths inches.

It will be noted that the lower ends of the inner faces of the arms 48 and 50 merge into the bar-receiving portion 59 at points which are close to the socket 46. As a result, as indicated by the dotted-line showing 55 of the bar of a bar-type weight in FIG. 2, the center of gravity of even a one-inch bar of such a weight is close to the socket 46. The center of gravity of a larger bar of a bar-type weight would actually be in register with that socket. As a result, any static force which the bar of a bar-type weight could apply to the bar-receiving portion 59 of saddle 44 would have only a very small moment arm, relative to the axis of socket 46; and that moment arm would, except in the case of the smallest-diameter bar, be less than the radius of that socket. Consequently, the maximum static force which a bar-type weight could apply to the saddle 44 would have a small moment arm, and hence could not develop a large turning couple.

The fact that the lower ends of the inner faces of the arms 48 and 50 merge into the bar-receiving portion 59 at points which are close to the socket 46 also is useful in reducing the moment arms of any dynamic forces that are applied to the bar-receiving portion 59 or to either of the arms 48 and 50. Those dynamic forces will usually be downwardly-directed, and they will cause the closest edge of the top of the leg 12 to serve as a momentary center of rotation. Consequently, the maximum moment arm for a dynamic force which was applied to the lip 49 would be less than one and seven-eighths of an inch, the maximum moment arm for a dynamic force which was applied to the inclined face of arm 48 would be less than one and one-half inches, the maximum moment arm for a dynamic force which was applied to the lip 51 would be less than one and three-eighths of an inch, and the maximum moment arm force which was applied to the inclined face of arm 50 would be less than one and three thirty-seconds of an inch.

Not only does the saddle 44 limit the moment arm of each turning couple which a static or dynamic force could apply to that saddle, but that saddle will dsitribute the resulting horizontally-directed rotation-resisting reaction forces of the socket 46 thereof along the length of the appropriate sides of that socket. In this way, that saddle and the upper end of leg 12 are easily able to withstand any and all forces which can be applied by turning couples. A line which was extended between the uppermost and lowermost horizontally-directed rotation-resisting reaction forces of any turning couple would extend diagonally of the socket 46. Because the depth or length of that socket is greater than the diameter of that socket, such a line would be longer than the diameter of that socket; and hence the effective moment arm of the rotation-resisting reaction forces would be greater than the diameter of socket 46. All of this means that the saddle 44 will limit the magnitudes of the turning couples which static or dynamic forces can apply to it, and it also means that the saddle 44 will provide a large moment arm for all rotation-resisting reaction forces. As a result, that saddle is fully capable of withstanding large static and dynamic forces.

The saddle 44 is cast or molded as a unitary element; and hence there are no joints between the socket 46 and either of the arms 48 and 50. Also, there are no joints between that socket and either of the gusset-like reinforcing portions 52 and 54, or between those gusset-like reinforcing portions and arms 48 and 50 and lips 49 and 51. Finally, there are no joints between the arms 48 and 50 and lips 49 and 51 or between those arms and the bar-receiving portion 59. Because that saddle is wholly devoid of joints, it is very rugged and strong. Also, because that saddle has a socket which telescopes downwardly over, and intimately engages, the upper end of leg 12, rather than being welded to that leg, that saddle will fully resist any accidentally-applied forces that would tend to tilt it relative to, or to separate it from, the leg 12. All of this means that the saddle 44 provides a completely-predictable degree of dependability and reliability which has not heretofore existed in saddles for the bars of bar-type weights.

The saddle 44 preferably is made from glass filled polycarbonate, because that material has a high degree of impact resistance and strength but is readily molded. However if desired, that saddle could be cast or molded from other rugged and sturdy readily-molded plastic materials or could be cast or molded from aluminum, aluminum alloys, brass or other readily-cast but sturdy metals or alloys.

A surface 56 inclines downwardly from the bar-receiving portion 59 to the upper edge of the gusset-like reinforcing portion 52; and the lower end of that surface is about one-eighth of an inch below the level of that bar-receiving portion. That one-eighth of an inch downward displacement of that lower end plus the radius at the upper edge of reinforcing portion 52 will keep the bar, of a bar-type weight, from pinching a weight-lifter's finger—even if a part of that finger extends into the space above the lower end of the surface 56. A similar surface 58 inclines downwardly from the bar-receiving portion 59 to the upper edge of the gusset-like reinforcing portion 54; and the lower end of that surface is about one-eighth of an inch below the level of that bar-receiving portion. That one-eighth of an inch downward displacement of that lower end plus the radius at the upper edge of reinforcing portion 54 will keep the bar, of a bar-type weight, from pinching a weight-lifter's finger—even if a part of that finger extends into the space above the lower end of the surface 58.

An opening 60 is provided in the side wall of the portion of saddle 44 in which the socket 46 is located; and the shank of a set screw 62 is dimensioned to pass through that opening. A tapped opening 63 is provided in the upper end of leg 12 in register with the opening 60 in saddle 44; and the set screw 62 passes through the opening 60 and is seated in the tapped opening 63. The axis of the tapped opening 63 is displaced ninety degrees from the axes of the openings 34, 36, 38 and 40 in the leg 12. As a result, when the opening 60 in saddle 44 is aligned with the opening 63 in that leg and the screw 62 is passed through opening 60 and seated in opening 63, the bar-receiving portion 59 of that saddle will be displaced ninety degrees from the axes of openings 34, 36, 38 and 40. Also, at that ime, the arm 50 will overlie a portion of the longeron 20, and the arm 48 will extend rearwardly beyond the rear of the leg 12. If desired, the opening 63 could be a drilled or punched opening and the screw 62 could be a self-tapping screw.

The arm 48 is longer than the arm 50; and the angular disposition of arm 48 disposes the upper end of that arm a considerable distance above the level of the upper end of arm 50. This is desirable, because it will enable a weight lifter to easily move the bar of a bar-type weight over the upper end of arm 50 as that weight lifter moves that bar out of its rest position to its use position, and then subsequently returns that bar to its rest position; and yet will minimize any likelihood of that bar being moved rearwardly and out of register with the recess defined by the arms 48 and 50.

The numeral 64 denotes a saddle which is identical to the saddle 44. The socket 46 in saddle 64 telescopes downwardly over, and intimately engages, the upper end of the leg 14; and a screw 62, not shown, will pass through an opening 60 in that saddle and seat in an opening 63, not shown, in the upper end of the leg 14.

The bar-receiving areas, which are defined by the arms of the saddles 44 and 64, are in alignment. Those areas will coact to receive, and to provide solid support for, the bar of a bar-type weight.

Referring particularly to FIGS. 6 and 7, the numeral 66 generally denotes an alternate form of saddle which is provided by the present invention. That saddle preferably is identical to the saddle 44, except for the presence of axially-directed ribs 70 in the leg-receiving socket 68 thereof. The radial dimensions of those ribs are one-eighth of an inch. Those ribs enable the saddle 66 to telescope over a leg which has an outer diameter of one inch, whereas the socket 46 of saddle 44 enables the latter socket to telescope over a leg which has an outer diameter of one and one-quarter inches. By providing the ribs 70, the present invention makes it possible for the saddle 66 to be molded in the same mold in which the saddle 44 is molded—it merely being necessary to use an adapter in that mold to effect the formation of the ribs 70.

Whereas the drawing and accompanying description have shown and described two preferred embodiments of the present invention it should be apparent to those skilled in the art that various changes may be made in the form of the invention without affecting the scope thereof.

What I claim is:

1. A saddle, which is mountable on the upper end of an upwardly-directed part of a support for a bar of a bar-type weight used by a weight lifter and which can selectively receive and support part of a bar of a bar-type weight, and which has a bar-receiving portion, a first arm which inclines upwardly and forwardly from said bar-receiving portion, a second arm which inclines upwardly and rearwardly from said bar-receiving portion, said bar-receiving portion and said arms coacting to define a saddle-like space which can selectively receive and confine said part of said bar of said bar-type weight, a socket-forming portion which extends downwardly from said bar-receiving portion and which defines a socket with an upper end that underlies at least a part of said bar-receiving portion and with a sidewall that extends downwardly from said upper end and downwardly relative to said arms and that is dimensioned to telescope down over, and to closely engage, said upper end of said upwardly-directed part of said support for a bar of a bar-type weight, said socket having an open lower end that is dimensioned to telescope down over said upper end of said upwardly-directed part of said support for a bar of a bar-type weight, said saddle being molded or cast from a readily-molded or readily-cast plastic material so it is unitary in nature and so it is wholly devoid of joints between any of said bar-receiving portion, said arms and said socket-forming portion, said socket-forming portion having the walls of said socket tapered upwardly and inwardly to provide intimate engagement between the upper, inner end of said recess and said upper end of said upwardly-directed part of said support for a bar of a bar-type weight, a reinforcing portion that is part of, and that extends between, said socket-forming portion and said first arm, said reinforcing portion extending forwardly and upwardly from said socket-forming portion to merge into said first arm, said reinforcing portion being generally tangential relative to one side of said socket-forming portion and thereby defining one side of said first arm, a second reinforcing portion that is part of, and that extends between, said socket-forming portion and said first arm, said second reinforcing portion extending forwardly and upwardly from said socket-forming portion to merge into said first arm, said second reinforcing portion being generally tangential relative to the opposite side of said socket-forming portion and thereby defining the opposite side of said first arm, second reinforcing portion being spaced from the first said reinforcing portion and coacting with said first said reinforcing portion and with said first arm to define a supporting arm which is an inverted U in end view and which is sturdy and rugged but light in weight, and said first arm and said bar-receiving portion merging at a point which is immediately adjacent the upper end of said socket and said second arm and said bar-receiving portion merging at a further point which is immediately adjacent the upper end of said socket to thereby limit the moment arm of any force which a bar-type weight can apply to said bar-supporting portion.

2. A saddle, which is mountable on the upper end of an upwardly-directed part of a support for a bar of a bar-type weight used by a weight lifter and which can selectively receive and support part of a bar of a bar-type weight, and which has a bar-receiving portion, a first arm which inclines upwardly and forwardly from said bar-receiving portion, a second arm which inclines upwardly and rearwardly from said bar-receiving portion, said bar-receiving portion and said arms coacting to define a saddle-like space which can selectively receive and confine said part of a bar of a bar-type weight, a socket-forming portion which extends downwardly from said bar-receiving portion and which defines a socket with an upper end that underlies at least a part of said bar-receiving portion and with a sidewall that extends downwardly from said upper end and downwardly relative to said arms and that is dimensioned to telescope down over, and to closely engage, said upper end of said upwardly-directed part of said support for a bar of a bar-type weight, said saddle being molded or cast from a readily-molded or readily-cast plastic material so it is unitary in nature and so it is wholly devoid of joints between any of said bar-receiving portion, said arms and said socket-forming portion, said socket-forming portion having the walls of said socket tapered upwardly and inwardly to provide intimate engagement between the upper, inner end of said recess and said upper end of said upwardly-directed part of said support for a bar of a bar-type weight, the upper end of said first arm terminating in a forwardly-extending, horizontally-directed lip, a reinforcing portion that is part of, and that extends between, said socket-forming portion and said first arm and said lip, said reinforcing portion inclining forwardly and upwardly from said socket-forming portion to merge into said lip to reinforce said lip and also to provide a surface to guide outwardly beyond said lip any bar of a bar-type weight which was being raised upwardly while it was so close to said support for a bar of a bar-type weight that it was in register with said lip, said lip increasing the effective area which a bar of a bar-type weight could engage, as that bar is being lowered, without being directed away from said saddle-like space, said reinforcing portion serving, if a bar of a bar-type weight were being raised upwardly along a path that would cause a bar to engage the under surface of said lip, to intercept an upwardly-raised bar and guide it outwardly relative to said lip so a bar could be raised upwardly past said lip without being impeded or intercepted by said lip.

3. A saddle, which is mountable on the upper end of an upwardly-directed part of a support for a bar of a bar-type weight used by a weight lifter and which can selectively receive and support part of a bar of a bar-type weight, and which has a bar-receiving portion, a first arm which inclines upwardly and forwardly from said bar-receiving portion, a second arm which inclines upwardly and rearwardly from said bar-receiving portion, said bar-receiving portion and said arms coacting to define a saddle-like space which can selectively receive and confine said part of a bar of a bar-type weight, a socket-forming portion which extends downwardly from said bar-receiving portion and which defines a socket with an upper end that underlies at least a part of said bar-receiving portion and with a sidewall that extends downwardly from said upper end and downwardly relative to said arms and that is dimensioned to telescope down over, and to closely engage, said upper end of said upwardly-directed part of said support for a bar of a bar-type weight, said socket having an open lower end that is dimensioned to fully telescope down over said upper end of said upwardly-directed part of said support for said bar of said bar-type weight, said saddle being molded or cast from a readily-molded or readily-cast plastic material so it is unitary in nature and so it is wholly devoid of joints between any of said bar-receiving portion, said arms and said socket-forming portion, said socket-forming portion having the walls of said socket tapered upwardly and inwardly to provide intimate engagement between the upper, inner end of said recess and said upper end of said upwardly-directed part of said support for said bar of said bar-type weight, said bar-receiving portion having one edge thereof which can confront said weight lifter whenever said saddle is mounted adjacent the left-hand side of said weight lifter, said bar-receiving portion having a second edge which can confront said weight lifter whenever said saddle is mounted adjacent the right-hand side of said weight lifter, and means on said bar-receiving portion which is a part of the upper surface of said bar-receiving portion and which is spaced inwardly from said one edge and also from said second edge of said of said bar-receiving portion to constitute a ridge that is intermediate, and that is displaced inwardly from, said one edge and also from said second edge of said bar-receiving portion, said ridge being located above the level of said one edge and also above the level of said second edge of said bar-receiving portion, said ridge on said upper surface of said bar-receiving portion being disposed to intercept a bar of a bar-type weight before said bar can move far enough downwardly to engage either said one edge or said second edge of said bar-receiving portion, whereby a finite vertical gap will exist between a bar of a bar-type weight and said one edge and a second finite vertical gap will exist between a bar of a bar-type weight and said second edge of said bar-receiving portion whenever a bar is resting upon said ridge of said bar-receiving portion, whereby said saddle can help protect the fingers of said weight lifter whether said saddle is mounted adjacent the left-hand side or adjacent the right-hand side of said weight lifter.

4. A saddle as claimed in claim 3 wherein said ridge is generally planar and is parallel to said edges of said saddle, and wherein both of said edges of said bar-receiving portion are rounded to effectively increase the vertical dimensions of the outermost portions of said finite vertical gaps.

* * * * *